United States Patent [19]

Albert

[11] Patent Number: 4,946,123

[45] Date of Patent: Aug. 7, 1990

[54] ROOF BRACKET

[76] Inventor: Rino P. Albert, 53 Shademaster Ct., Scarborough, Ontario, Canada M1B 1Y5

[21] Appl. No.: 385,082

[22] Filed: Jul. 26, 1989

[30] Foreign Application Priority Data

Aug. 4, 1988 [CA] Canada ..... 573852

[51] Int. Cl.[5] ..... E04G 27/00

[52] U.S. Cl. ..... 248/237; 182/45

[58] Field of Search ..... 248/237, 300; 182/45

[56] References Cited

U.S. PATENT DOCUMENTS

| | | | |
|---|---|---|---|
| 236,587 | 1/1881 | Hoerner | 248/237 |
| 302,157 | 7/1884 | Porter | 248/237 |
| 302,896 | 8/1884 | Daily | 248/237 |
| 974,609 | 11/1910 | Snyder | 248/237 |
| 1,255,692 | 2/1918 | Bearden | 248/237 |
| 1,301,533 | 4/1919 | Anderson | 248/237 |
| 1,341,597 | 5/1920 | Showalter | 248/237 |
| 1,562,965 | 11/1925 | Hubschmitt, Jr. | 248/237 |
| 1,639,352 | 8/1927 | Schade | 248/237 |
| 1,886,921 | 11/1932 | Tobin | 182/45 X |
| 4,020,921 | 6/1977 | Rawlings | 182/45 |

*Primary Examiner*—David L. Talbott

[57] ABSTRACT

A roofing bracket has a flat arm for nailing to a roof truss, a flat approximately co-planar cross-piece to extend transversely to the arm and a lower support perpendicular to the arm member to support a beam.

6 Claims, 3 Drawing Sheets

ROOF BRACKET

This invention relates to a device to assist roofers in working on a roof in such application as shingling, applying tar paper and the like.

The invention provides a support for a roofer working on a sloping roof, from the lower edge of the roof upward.

The invention provides a metal member comprising an arm designed to extend upwardly along the roof and a rigidly connected cross piece designed to be transverse thereto. The arm and cross piece are designed to be flat in a common plane and to lie with such flat plane assuming the altitude of the sloping roof sub-surface—(usually plywood).

The metal arm includes support means rigidly connected thereto, designed to extend upwardly and outwardly relative to said arm and perpendicularly thereto. Said support is located to support a wooden beam standing edgewise on said arm and located below said cross piece. Passages are provided in said arm and cross piece for nailing these members to roof structural members and a passage is provided in said support allowing nailing of said support to said beam.

In a preferred embodiment of the invention, a respective cross piece extending from each side of the arm, has advantages in the following situations. In each situation the arm is nailed to a roof truss, that is along the member sloping up the roof. This will usually be through plywood or boards forming the base surface for the roof. Where the invention is used at the base of the roof the cross piece, on each side of the arm is nailed to the face board, that is the beam which joins the lower end of the roof trusses. Thus the cross piece nailed on both sides provides lateral stability to the board and to the beam and personnel supported thereby. Where the bracket is used at the ends of the face board, the cross piece extending on each side, provides the alternative sides for attachment for use at opposite ends of the roof. Where the bracket is used part way up the roof, the arm may be nailed to a truss through the boards or plywood but there is usually no transverse structural member to which the cross piece may be nailed. However the cross piece bears on the base surface of board or plywood on both sides of the arm and stabilizes it against turning.

A preferred aspect of the invention described in the two previous paragraphs provides, for each nailing aperture in the arm or cross pieces, a parallel slot extending from the intended positions of said nails downwardly and outwardly to the edge of the member. Such slots allow quick and easy removal of a nailed down bracket when no longer needed. A hammer strikes the base or support of the bracket to move it upwardly so that it moves about the nails until the end of the slot passes the nail and the bracket may simply be lifted away from the roof. The nails may then be hammered until they are flush with the roof base surface.

In drawings which illustrate a preferred embodiment of the invention:

Figure 1:
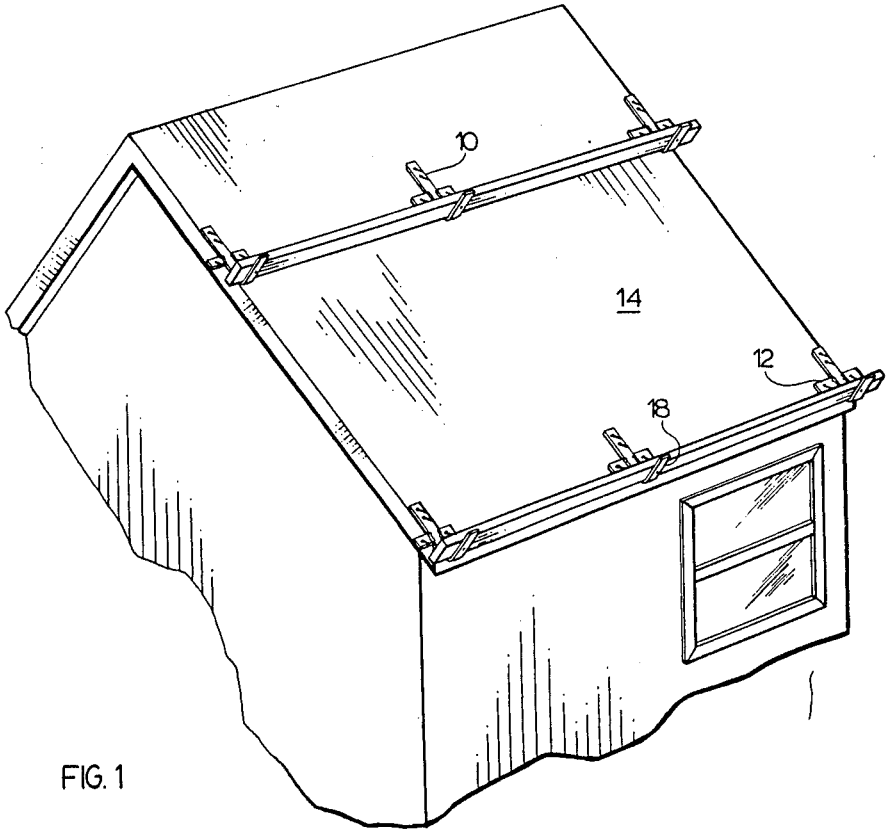
FIG. 1 is a perspective view of the invention in use

In the drawings: An arm 10 is composed of flat, longitudinally extending steel of about ⅝ thickness and about 1½ wide. Two cross pieces 12 of similar steel are rigidly attached to the arm to extend on each side thereof and to define with the arm an approximately common plane so that the arm and cross pieces are arranged on the base surface such as plywood 14 to be parallel thereto with the arm extending upwardly therealong.

The arm is extended downwardly below the cross pieces to a depth greater than the thickness of the beam to be supported by the bracket.

A support 18 extends integrally upwardly from the lower end of the arm with the flat sides perpendicular to the plane of the arm and cross piece.

The arm is provided with a pair of nailing apertures 20 and 22 at least one of which is near the upper end of the arm. Each cross piece is provided with a nailing aperture 24. The nailing apertures 20, 22 and 24 are at the ends of parallel slots 26 extending downwardly and outwardly from the aperture to the edge of the member in which it is contained. The support is provided with a normal nailing aperture 28.

Figure 5:
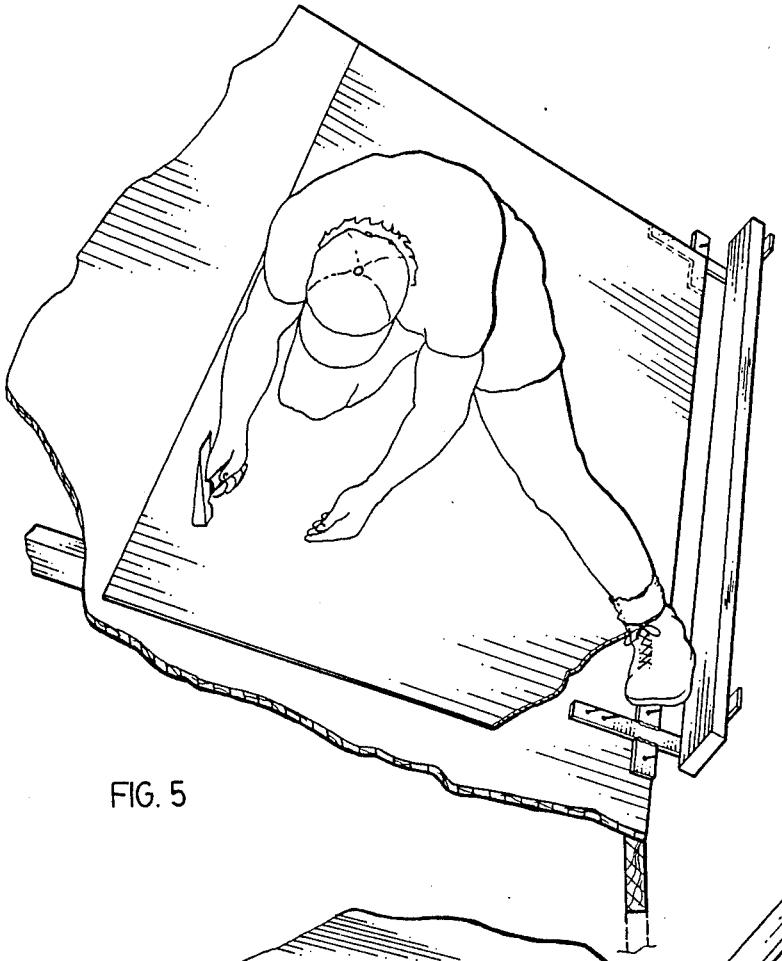
FIG. 5 shows the invention in use.
Figure 2:
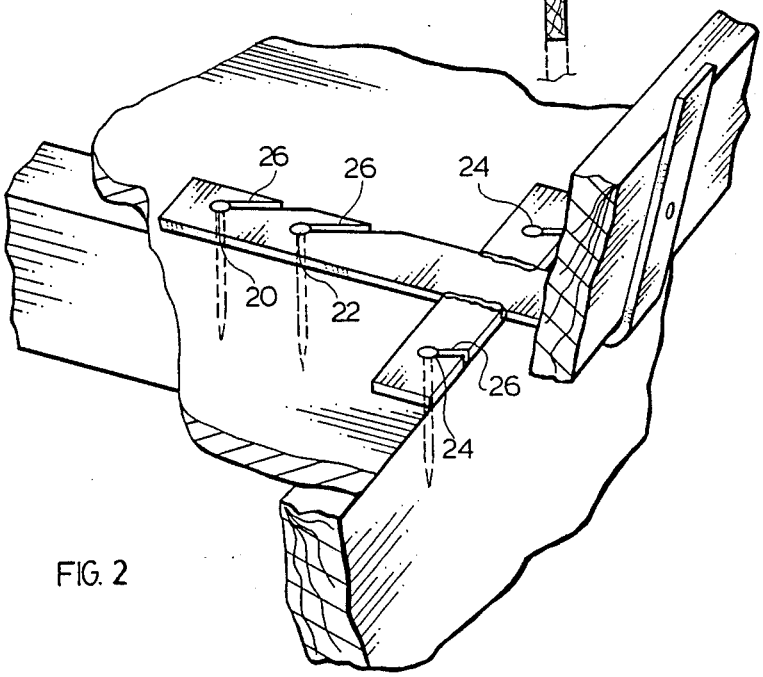
FIG. 2 shows the invention applied at the base of the roof
Figure 6:
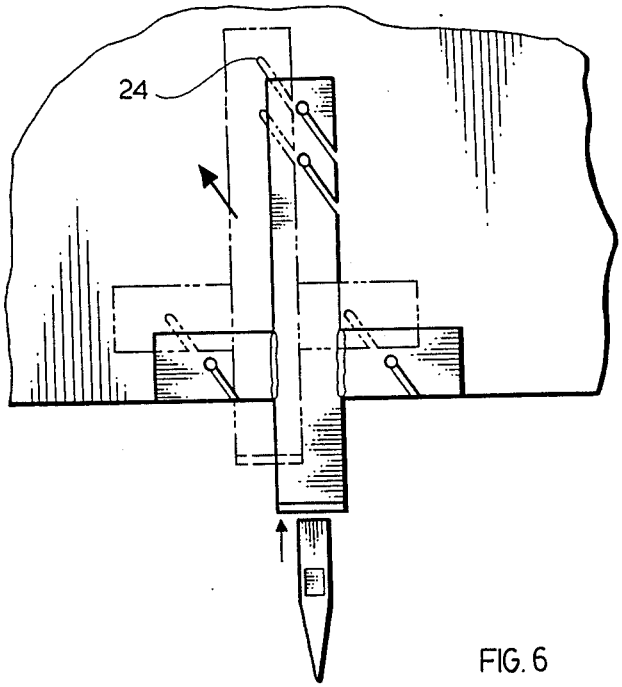
FIG. 6 shows the mode of removal of the invention.
Figure 4:
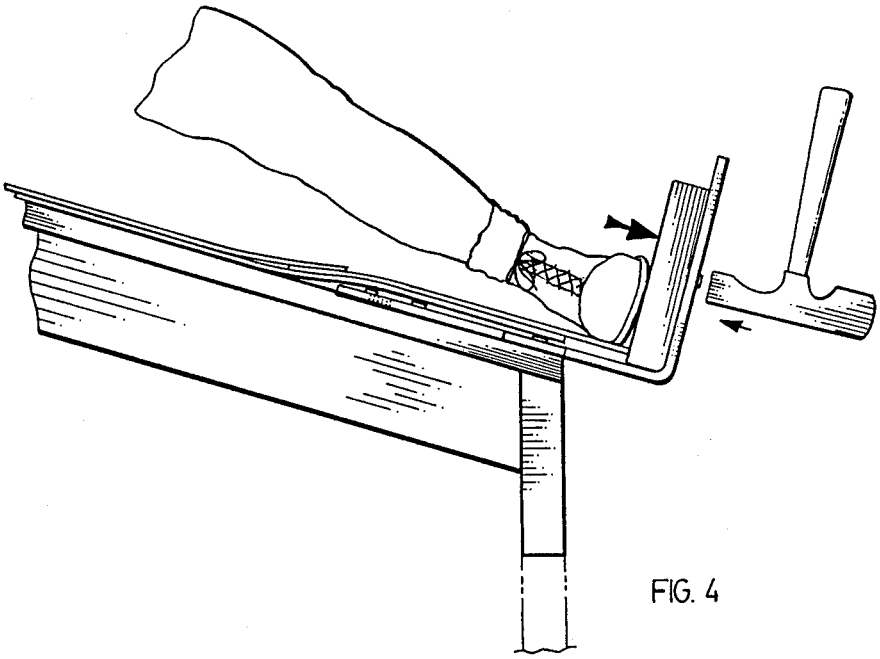
FIG. 4 shows the application of the beam to the support

In use, where the brackets are needed on the lower edge of the roof they are located on the plywood base surface with the arm over a truss and the cross pieces extending along the face board (FIG. 2). The arm is then nailed to the truss and the cross piece to the face board. The support will then be located below and outside of the face board by more than the thickness of the beam to be used (usually a 2″×10″). The beam is then placed edgewise on the arm to be supported by the support member. The support member is then nailed to the beam and the beam will extend over a number of support members. The nailer places his weight on the beam to press it against to support while nailing (FIG. 4). The support with beam is then used by the worker to support himself and his tools and materials as he works on the roof (FIG. 5). This will be mainly but not exclusively for shingling. The lower extent of the shingle can overlie the flat portion of the bracket. When the support is no longer needed each bracket is hammered upwardly until the nails escape from the slots and the brackets with beam may be removed (FIG. 6). The beam may be removed from the brackets. The nails projecting from the roof base surface by slightly more than the thickness of the plates are then hammered flush with the base surface, which may require temporary raising of the lower portion of the lower shingle.

Figure 3:
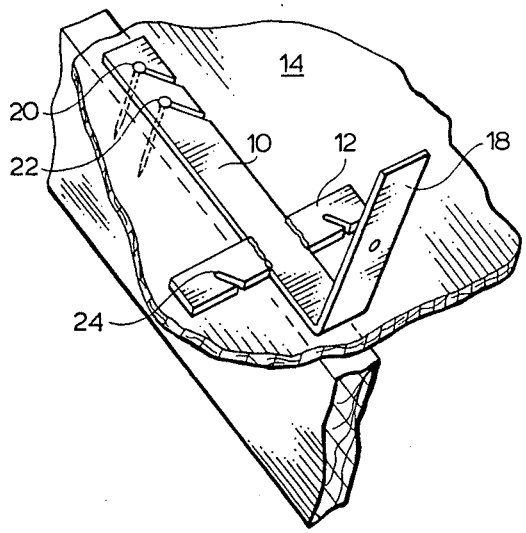
FIG. 3 shows the invention applied part way up a roof

To use the brackets part way up a roof the arm is nailed to a roof truss at the desired height (FIG. 3). There is usually no cross member to nail the cross piece to. The remainder of the procedure for installation of the beam and later removal of the bracket from the roof and the beams from the bracket are as described in the previous paragraph. The brackets are not quite so secure as with the cross pieces nailed down but the worker is much safer at the middle than at the bottom of the roof.

When the bracket is used at either end of the roof, see the two end brackets at each level in FIG. 1 and the bracket at the right hand end of FIG. 5 the arm 10 must run along the end roof truss for nailing thus the outward projection of cross piece 12 in each case must project unattached beyond the edge of the roof. At the brackets on the lower edge of the roof the inward projection of cross piece 12 is nailed to the face board. As previously stated, the cross piece 12 extending on each side ensures that there is at least one arm for nailing to the face board.

I claim:

1. Roofing device comprising:

flat metal arm adapted to be applied flatwise to a sloping roof to extend upwardly thereon, a pair of flat cross members rigidly attached to said metal arm to be approximately coplanar therewith and extending perpendicularly thereto, on each side of said arm, said metal arm including an extent located to extend downward beyond said cross member, a support extending upwardly and perpendicular to said roof from the lower end of said extent to support a wooden beam having its width dimension extending upwardly and outwardly and perpendicular to said roof in the desired orientation, said device defining a relatively flat lower surface and a relatively flat upper surface, passages in said arm and cross member for nailing said device to said roof.

2. Roofing device as claimed in claim 1 wherein said passages in said arm and cross member comprise parallel slots extending from the intended position of said nails downwardly and outwardly to the edge of the relevant member.

3. Device as claimed in claim 2 including means for removing said device from said truss without withdrawal of said nails.

4. Device as claimed in claim 2 having such wooden beam nailed to said support.

5. Device as claimed in claim 1 having such wooden beam nailed to said support.

6. Roofing device having a desired orientation on a sloping roof comprising:

flat metal arm adapted to be applied flatwise to such sloping roof comprising:

a flat cross member approximately coplanar with said arm rigidly attached to said metal arm to extend in at least one direction transversely thereto, passages in said arm and cross member for nailing said device to said roof, support means rigidly connected to the lower end of said arm and below said cross member to extend upwardly and perpendicular to said roof to support a wooden beam having its width dimension extending upwardly and outwardly and perpendicular to said roof in the desired orientation, said device having a relatively flat lower surface and a relatively flat upper surface above said support.

* * * * *